US011583079B1

(12) United States Patent
Pherson

(10) Patent No.: US 11,583,079 B1
(45) Date of Patent: Feb. 21, 2023

(54) FURNITURE SPACER

(71) Applicant: Michael D. Pherson, Naples, FL (US)

(72) Inventor: Michael D. Pherson, Naples, FL (US)

( * ) Notice: Subject to any disclaimer, the term of this patent is extended or adjusted under 35 U.S.C. 154(b) by 0 days.

(21) Appl. No.: 17/477,603

(22) Filed: Sep. 17, 2021

(51) Int. Cl.
*A47B 95/00* (2006.01)
*A47B 91/12* (2006.01)
*A47B 95/04* (2006.01)

(52) U.S. Cl.
CPC ..... *A47B 95/002* (2013.01); *A47B 91/12* (2013.01); *A47B 95/043* (2013.01); *A47B 2095/004* (2013.01)

(58) Field of Classification Search
CPC .. A47B 95/002; A47B 91/12; A47B 2095/004
USPC ..... 312/245
See application file for complete search history.

(56) References Cited

U.S. PATENT DOCUMENTS 2,608,794 A 9/1952 Matter
3,422,798 A * 1/1969 Pine ..... E04F 21/0069 118/504
4,232,068 A * 11/1980 Hoh ..... E06B 1/6069 428/167
D257,761 S * 1/1981 Abel ..... D8/355
5,220,705 A 6/1993 Bushey
5,803,423 A * 9/1998 Harrell ..... A47B 97/00 248/345.1
6,230,446 B1 * 5/2001 Chalich ..... E06B 1/6069 52/98
D503,864 S * 4/2005 DiFanti ..... D8/402
7,124,986 B1 10/2006 Bailey
8,061,676 B1 * 11/2011 Kumar ..... A47C 7/62 248/500
8,424,828 B1 * 4/2013 Roccasalva ..... A47B 95/00 248/346.11
2012/0061545 A1 3/2012 Schneider
2018/0271278 A1 * 9/2018 Weber ..... D06F 39/125
2021/0361069 A1 * 11/2021 Howell ..... A47B 97/00

FOREIGN PATENT DOCUMENTS

AU 2016101952 A4 * 12/2016
CA 2124017 1/1996
WO WO-2022010336 A1 * 1/2022

* cited by examiner

*Primary Examiner* — Daniel J Troy
*Assistant Examiner* — Timothy M Ayres
(74) *Attorney, Agent, or Firm* — Loeffler IP Group, P.A.; Bryan L. Loeffler, Esq.

(57) ABSTRACT

A furniture spacer (1) that maintains an even gap between a piece of furniture and a wall thereby protecting the furniture and wall from damage while providing an attractive design aesthetic.

6 Claims, 3 Drawing Sheets

FURNITURE SPACER

FIELD OF THE INVENTION

The present invention relates to interior design, furniture placement, and more particularly, a furniture spacer that maintains an even gap between a piece of furniture and a wall thereby protecting the furniture and wall from damage while providing an attractive design aesthetic.

BACKGROUND OF THE INVENTION

Furniture in homes and offices is commonly placed against walls. Such furniture may include sofas, couches, headboards, desks, tables, bureaus, and so forth, that can accidentally rub or scrape against walls, thereby causing damage to the walls and/or damage to the furniture. For this reason, a space is normally left between a piece of furniture and a wall. However, furniture still has a tendency of being pushed against walls during regular use, especially on wood and tile floors.

In addition to aesthetics and preventing damage to furniture and walls, a user may also want to position furniture away from walls to provide space for electrical outlets, wires, baseboard heaters, and other objects that require air flow to prevent fire hazards.

Therefore, a need exists for a furniture spacer that maintains an even gap between a piece of furniture and a wall thereby protecting the furniture and wall from damage while providing an attractive design aesthetic.

SUMMARY OF THE INVENTION

The primary object of the present invention is to provide a furniture spacer that maintains an even gap between a piece of furniture and a wall thereby protecting the furniture and wall from damage while providing an attractive design aesthetic.

The present invention fulfills the above and other objects by providing a protective furniture spacer having a preferably rectangular-shaped planar body that attaches to a bottom surface of a furniture leg. Furniture normally has glides attached to the bottom surface of each leg to prevent damage to leg and to the floor. Guides may be made of plastic, nylon, metal, felt rubber, and/or equivalent material, wherein, each glide acts as a protective barrier between the bottom surface of the leg and the floor.

An aperture is preferably located on a proximal end of the rectangular-shaped body to engage a glide and the bottom surface of the furniture leg. The glide extends through the aperture while the proximal end of the body is sandwiched between the bottom surface of the leg and the floor, thereby locking the protective furniture spacer on the furniture leg while not affecting the height of the furniture.

In addition, the furniture spacer of the present invention may be further secured to the bottom surface of the leg using an adhesive, nail, tack, etc., located on a top surface of the body on the proximal end thereof to prevent the furniture spacer from disengaging from the glide and the bottom surface of the furniture leg if the furniture is lifted off the ground.

The rectangular-shaped body extends from the bottom of the furniture leg at a perpendicular angle in relation to the furniture leg and the wall and a parallel angle in relation to the floor. A distal end of the body presses against the wall to create a gap between the furniture leg and the wall. Additional furniture spacers of the present invention are preferably installed on each rear leg of a piece of furniture to maintain a desired gap with the wall. The distal end may have a foot that extends perpendicularly from the distal end to further engage the surface of a wall or baseboard. The foot may be integrated into the body or attachably removable to the distal end of the body.

The length of the furniture spacer or a set of furniture spacers may be manually cut to desired lengths and/or an individual may use score lines located adjacent to the distal end of the body to snap or break sections of the body off the distal end to achieve a desired furniture spacer length.

A bottom surface of the body may have a non-slip material located thereon to prevent furniture from sliding on tile or wood floors.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which:

FIG. 6 is a magnified side view of FIG. 5 showing the furniture spacer of the present invention in use on a sofa; and.

DESCRIPTION OF THE PREFERRED EMBODIMENTS

Figure 1:
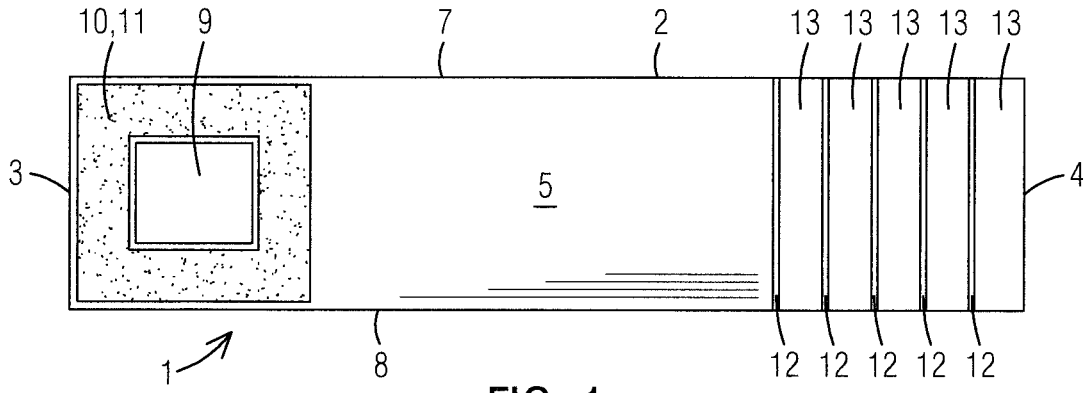
FIG. 1 is a top view of a furniture spacer of the present invention.
Figure 2:
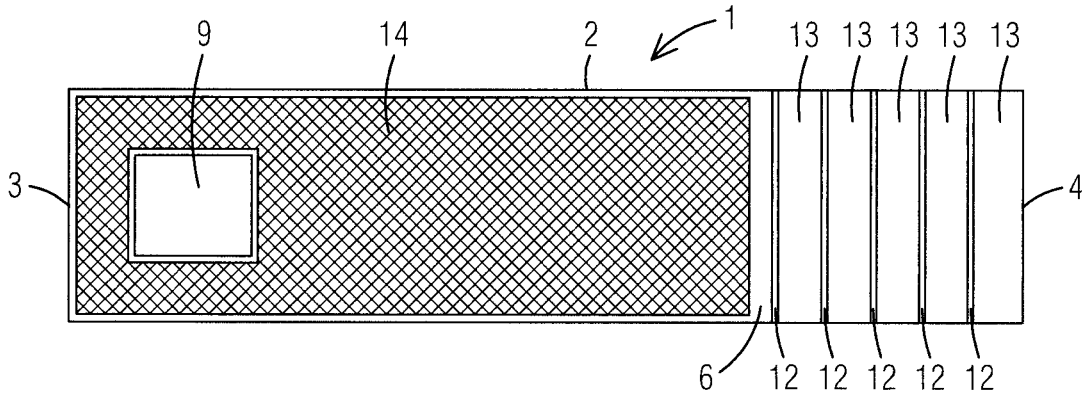
FIG. 2 is a bottom view of a furniture spacer of the present invention.
Figure 3:
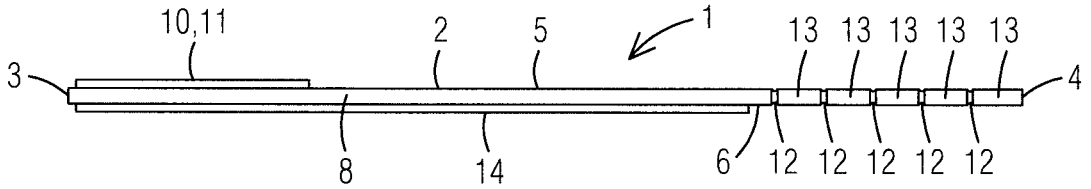
FIG. 3 is a left side view of a furniture spacer of the present invention.
Figure 4:
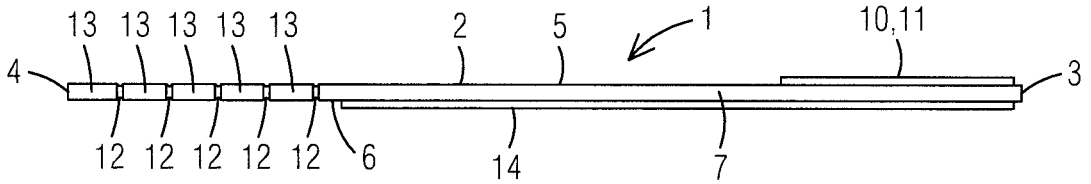
FIG. 4 is right side view of a furniture spacer of the present invention.

For purposes of describing the preferred embodiment, the terminology used in reference to the numbered accessories in the drawings is as follows:

1. furniture spacer, generally
2. body
3. proximal end of body
4. distal end of body
5. top surface of body
6. bottom surface of body
7. right side edge of body
8. left side edge of body
9. aperture
10. attachment means
11. adhesive
12. score line
13. pre-measured section
14. non-slip surface
15. sofa
16. bottom surface of furniture leg
17. furniture leg
18. wall
19. floor
20. baseboard
21. glide With general reference to FIGS. 1-4, various views of a furniture spacer 1 of the present invention are illustrated. The furniture spacer 1 comprises a preferably rectangular-shaped planar body 2 having a proximal end 3, a distal end 4, a top surface 5, a bottom surface 6, a right side edge 7, and a left side edge 8.

Figure 6:
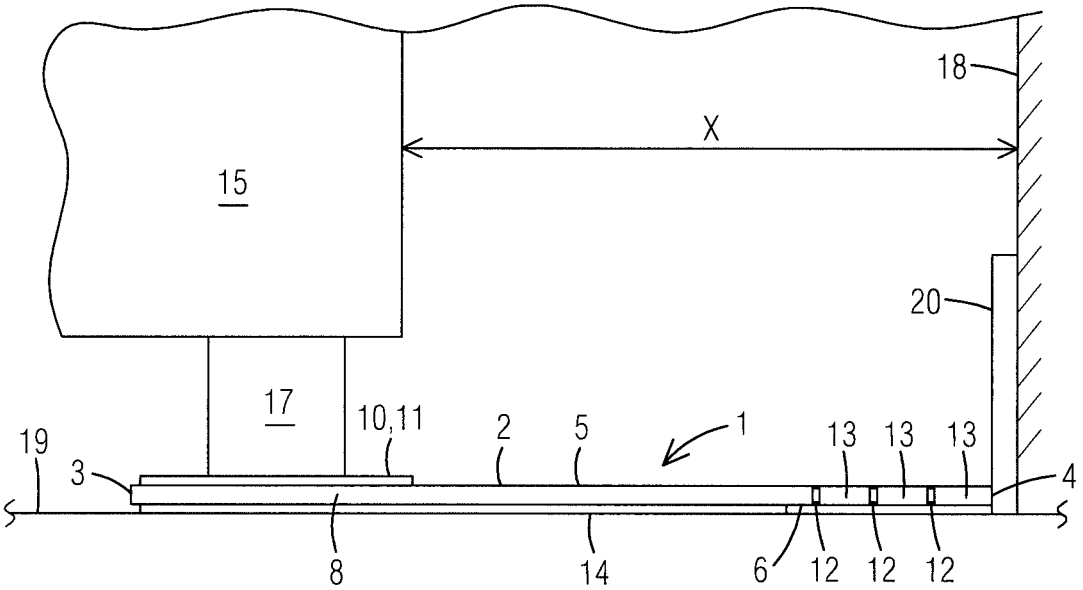
Figure 7:
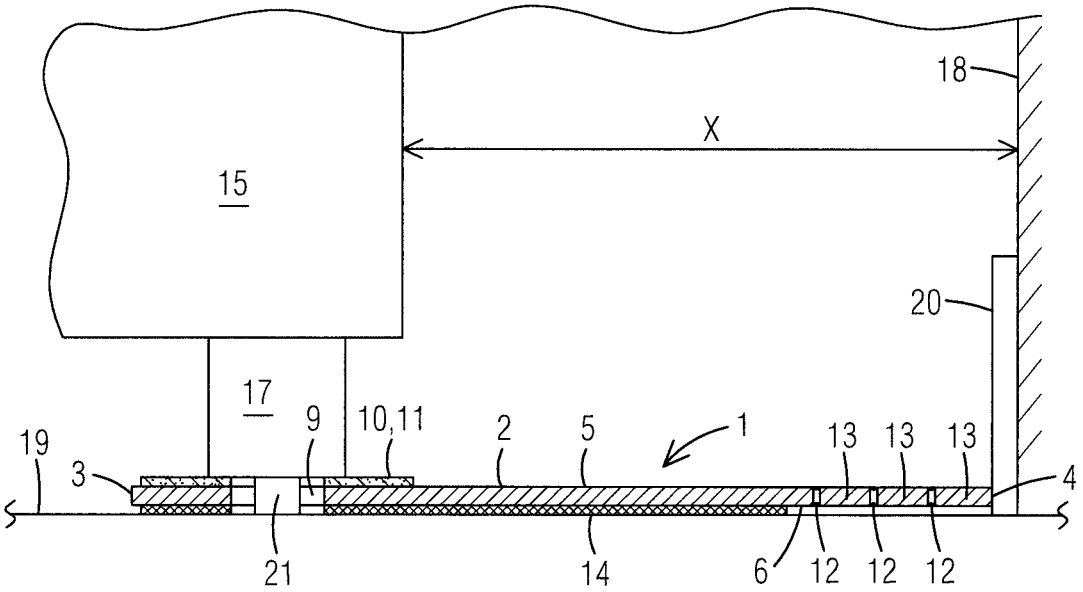
FIG. 7 is a sectional view along lines A-A of FIG. 6.

An aperture 9 is preferably located on the proximal end 3 of the body 2 to engage a glide and a bottom surface of a furniture leg, as illustrated in FIG. 6. In addition, the furniture spacer 1 of the present invention may be further secured to the bottom surface of the leg using an attachment means 10, such as an adhesive 11, nail, tack, or equivalent, located on the top surface 5 of the body 2 on the proximal end 3 thereof to prevent the furniture spacer 1 from disengaging from the glide and the bottom surface of the furniture leg if the furniture is lifted off the floor.

Figure 5:
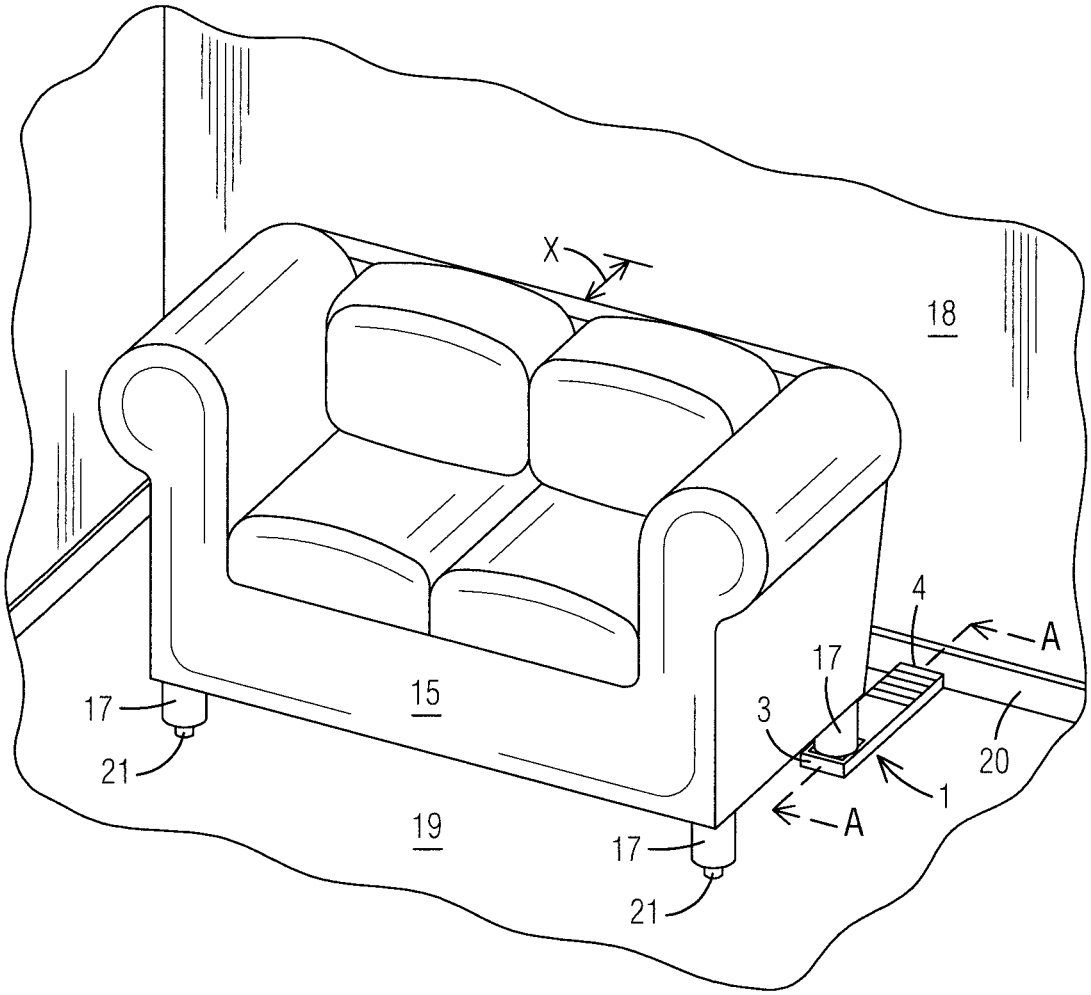
FIG. 5 is a perspective of a furniture spacer of the present invention in use on a sofa.

The length of the furniture spacer 1 or a set of furniture spacers may be manually cut to desired lengths and/or an individual may use score lines 12 extending between the right side edge of the body 2 and the left side edge 7 of the body 2 adjacent to the distal end 4 of the body 2. The score lines 12 allow an individual to snap or break pre-measured sections 13 of the body 1 off the distal end 4 to achieve a desired length of the furniture spacer 1 and a desired distance between a piece of furniture and a wall, as illustrated in FIGS. 5 and 6.

The bottom surface 6 of the body 1 may have a non-slip surface 14 or texture located thereon to prevent furniture from sliding on tile or wood floors.

With reference to FIGS. 3-6, various views of a furniture spacer 1 of the present invention in use on a sofa 15 are illustrated. The body 2 of the furniture spacer 1 extends from a bottom surface 16 of a furniture leg 17 at a perpendicular angle in relation to the furniture leg 17 and the wall 18 and parallel to the floor 19. The distal end 4 of the body 2 presses against the wall 18 and/or baseboard 20 to create a gap "X" between the furniture leg 17 and the wall 18. Additional furniture spacers 1 of the present invention are preferably installed on each rear furniture leg 17 of the sofa 15 to maintain the desired gap "X" with the wall.

As more clearly illustrated in FIG. 6, the aperture 9 is preferably located on the proximal end 3 of the body 2 to engage a glide 21 and the bottom surface 16 of the furniture leg 17. The glide 21 extends through the aperture 9 while the proximal end 4 of the body 2 is sandwiched between the bottom surface 16 of the furniture leg 17 and the floor 19, thereby locking the furniture spacer 1 on the furniture leg 17 while not affecting the height of the furniture leg 17 or the sofa 15.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A method for maintaining a desired space between a piece of furniture and a wall using a furniture spacer having a body having a proximal end, a distal end, a top surface, a bottom surface, a right side edge, and a left side edge, and an aperture located on the proximal end of the body, said method comprising the steps of:

lifting a furniture leg and a glide located on a bottom surface of the furniture leg off of a floor and placing the glide through said aperture;

said furniture spacer having an adhesive located on said top surface of the body for further securing the furniture spacer to the bottom surface of the furniture leg;

placing said furniture leg back on said floor wherein said glide extends through the aperture to makes contact with the floor while the proximal end of the body is sandwiched between the bottom surface of the furniture leg and the floor, thereby locking the proximal end of the furniture spacer on the furniture leg while not affecting an overall height of a piece of furniture on which the furniture leg is located; and placing said piece of furniture and furniture spacer in a position against the wall wherein the distal end of the furniture spacer makes contact with said wall, thereby maintaining a desired space between the piece of furniture and the wall.

2. The method of claim 1 wherein:

said furniture spacer comprises at least one score line extending between the right side edge of the body and the left side edge of the body adjacent to the distal end of the body wherein said at least one score line forms a pre-measured section that may be removed from said body to adjust a length of said body.

3. The method of claim 1 wherein:

said furniture spacer comprises a non-slip surface located on said bottom surface of the body to prevent the furniture spacer from sliding on floors.

4. A method for maintaining a desired space between a piece of furniture and a wall using a furniture spacer having a body having a proximal end, a distal end, a top surface, a bottom surface, a right side edge, and a left side edge, and an aperture located on the proximal end of the body, said method comprising the steps of:

lifting a furniture leg and placing a glide located on a bottom surface of the furniture leg off of a floor and placing the glide through said aperture;

placing said furniture leg back on said floor wherein said glide extends through the aperture to makes contact with the floor while the proximal end of the body is sandwiched between the bottom surface of the furniture leg and the floor, thereby locking the proximal end of the furniture spacer on the furniture leg while not affecting an overall height of a piece of furniture on which the furniture leg is located; and placing said piece of furniture and furniture spacer in a position against the wall wherein the distal end of the furniture spacer makes contact with said wall, thereby maintaining a desired space between the piece of furniture and the wall.

5. The method of claim 4 wherein:

said furniture spacer comprises at least one score line extending between the right side edge of the body and the left side edge of the body adjacent to the distal end of the body wherein said at least one score line forms a pre-measured section that may be removed from said body to adjust a length of said body.

6. The method of claim 4 wherein:

said furniture spacer comprises a non-slip surface located on said bottom surface of the body to prevent the furniture spacer from sliding on floors.

* * * * *